United States Patent [19]

Campobenedetto et al.

[11] Patent Number: 4,748,919

[45] Date of Patent: Jun. 7, 1988

[54] LOW NOX MULTI-FUEL BURNER

[75] Inventors: Edward J. Campobenedetto, Wadsworth; Stephen A. Johnson, Homeworth, both of Ohio; Herbert Schuster, Oberhausen, Fed. Rep. of Germany

[73] Assignee: The Babcock & Wilcox Company, New Orleans, La.

[21] Appl. No.: 585,035

[22] Filed: Mar. 6, 1984

Related U.S. Application Data

[63] Continuation of Ser. No. 517,388, Jul. 28, 1983, abandoned, which is a continuation of Ser. No. 251,837, Apr. 8, 1980, abandoned.

[51] Int. Cl.[4] ..... F23D 1/02

[52] U.S. Cl. ..... 110/264; 110/263; 110/347; 431/284

[58] Field of Search ..... 431/174, 284, 285; 110/263, 264, 262, 347

[56] References Cited

U.S. PATENT DOCUMENTS

| | | | |
|---|---|---|---|
| 3,145,670 | 8/1964 | Copian et al. | 431/284 |
| 3,788,796 | 1/1974 | Krippene et al. | 431/2 |
| 3,904,349 | 9/1975 | Peterson et al. | 431/184 |
| 4,157,889 | 6/1979 | Bonnel | 110/263 X |
| 4,208,180 | 6/1980 | Nakayasu et al. | 431/284 |
| 4,270,895 | 6/1981 | Vatsky | 110/262 |
| 4,333,405 | 6/1982 | Michelfelder et al. | 110/264 |

*Primary Examiner*—Edward G. Favors

*Attorney, Agent, or Firm*—Robert J. Edwards; Robert C. Mai

[57] ABSTRACT

An improved multi-fuel burning method and apparatus having means for regulating the fuel-air mixture passing therethrough and including four separately controlled passageways delivering the air necessary for combustion and transport of the fuel while reducing the formation of nitrogen oxides.

1 Claim, 3 Drawing Sheets

LOW NOX MULTI-FUEL BURNER

This application is a continuation of application Ser. No. 517,388 filed July 28, 1983, which is a continuation of application Ser. No. 251,837 filed Apr. 8, 1980 all abandoned.

BACKGROUND OF THE INVENTION

1. Field of Invention

The present invention relates to fuel burners and more particularly to an improved multi-fuel burner for reducing the formation of nitrogen oxides ($NO_x$) by lowering the combustion zone temperature, decreasing the fuel and air mixing rate, and providing a reducing atmosphere in the combustion zone.

There is a present day growing concern with the immediate and long term problems created by the rapid increase in air pollution resulting from the rise in the industrial civilization level throughout the world. With this concerns comes an acute awareness that immediate steps must be taken to halt and reverse this upward trend in pollution. Great efforts are now being made by public and private economic sectors to develop measures for preventing potentially polluting particles and gases from being discharged into the atmosphere. One such source of atmospheric pollution is the $NO_x$ present in the stack emission of fossil fuel fired steam generating units.

Nitric oxide (NO) is an invisible, relatively harmless gas. However, as it passes through the vapor generator into the atmosphere and comes into contact with oxygen, it partially reacts to form nitrogen dioxide ($NO_2$) or other oxides of nitrogen collectively referred to as nitrogen oxides ($NO_x$). Nitrogen dioxide is a yellow-brown gas which, in sufficient concentrations, is toxic to animal and plant life. It is this gas which contributes to visible brownish haze in the atmosphere near industrial and metropolitan centers.

Nitrogen oxides are formed as a result of the reaction of nitrogen and oxygen at high temperatures and may be thermal nitric oxide and/or fuel nitric oxide. The former occurs from the reaction of the nitrogen and oxygen contained in the air supplied for the combustion of fossil fuel whereas the latter results from the reaction of the nitrogen contained in the fuel with the oxygen in the combustion air.

The rate at which thermal nitric oxide is formed is dependent upon any or a combination of the following variables: (1) flame temperature, (2) residence time of the combustion gases in the high temperature zone and (3) excess oxygen supply. The rate of formation of nitric oxide increases as flame temperature increases. However, the reaction takes time and a mixture of nitrogen and oxygen at a given temperature for a very short time may produce less nitric oxide than the same mixture at a lower temperature, but for a longer period of time. In vapor generators of the type discussed hereunder the combustion of fuel and air may generate flame temperatures in the order of 3,700° F., the time-temperature relationship governing the reaction is such that at flame temperatures below 2,900° F. no appreciable nitric oxide (NO) is produced via the thermal mechanism, whereas above 2,900° F. the rate of reaction increases rapidly.

The rate at which fuel nitric oxide is formed is principally dependent on the oxygen supply in the combustion zone and the nitric oxide production is minimized under a reducing atmosphere; that is, a condition where the level of oxygen in the combustion zone is below that required for a complete burning of the fuel.

It is apparent from the foregoing discussion that the formation of thermal nitric oxide can be reduced by reducing flame temperatures in any degree and will be minimized with a flame temperature at or below 2,900° F. and that the formation of fuel nitric oxide will be minimized by providing a reducing atmosphere in the ignition zone.

With the advent of stricter emission controls, manufacturers of fuel burning equipment have been actively seeking methods of limiting the amount of $NO_x$ pollutants which are formed from the combustion of fossil fuel. Heretofore, their efforts have been generally directed at either of the following two methods: two-stage combustion which calls for initial firing with a deficiency of air and the admission of the remaining air needed for complete combustion at a location remote from the burners, and another which calls for the addition of cooling surface in the combustion zone.

DESCRIPTION OF THE PRIOR ART

U.S. Pat. No. 3,788,796 discloses a method and apparatus for reducing the formation of nitric oxides when burning pulverized fuel including three separately controlled passageways delivering the air necessary for combustion of the fuel.

U.S. Pat. No. 3,904,349 discloses a fluent fuel burning apparatus including three passageways and separate means for apportioning the flow of combustion air among the passages so as to achieve complete combustion of the fuel while reducing the formation of nitrogen oxides. The aforementioned patents, however, apply only to single fuel firing and are not equipped to provide for multi-fuel firing capabilities.

SUMMARY OF THE INVENTION

The present invention provides an apparatus and method for reducing the formation of nitrogen oxides from a burner capable of firing multiple fuels in combination or singly and achieving complete burning of the carbonaceous fuels injected through the burner.

Accordingly, an improvement is made on fuel burners of the type disclosed in U.S. Pat. Nos. 3,788,796 and 3,904,349 by providing an arrangement wherein multiple fuels can be combusted in this fuel burning apparatus either singly or in combination. The burner wall is formed with an access opening for admitting that portion of the fuel burning apparatus which normally resides in the windbox whereas the furnace wall is formed with a burner port which accommodates the combining of fuel and air into a combustible mixture and the ignition thereof. The multi-fuel burning apparatus includes a first tubular conduit which is concentrically disposed about the central axis of the burner and having its outlet end opening adjacent to the burner port and its inlet end extending through the burner wall and terminating outside of the windbox. The first tubular conduit defines a central passageway and serves to convey any carbonaceous fuel (secondary fuel) and a portion of the combustion air for discharge through the burner port into a combustion chamber. Means are provided for supplying a portion of the necessary combustion air to the first tubular conduit for discharge into the burner port. For liquid fuels, independent means are provided for injection of the fuel into the combustion chamber. For secondary solid fuel, the fuel and a portion of the combustion air are in intimate contact with the air serving to transport the solid fuel into the combustion chamber. A second tubular conduit which is concentrically disposed about the first tubular conduit has its outlet end adjacent to the burner port and its inlet end extending through the burner wall and terminating outside the windbox. The second tubular conduit defines a central annular passageway and serve to convey pulverized coal and transport air into the burner port. Means are provided for supplying air entrained pulverized fuel to the second tubular conduit for discharge into the burner port. A first and second sleeve member are disposed within the windbox to direct combustion air therefrom to the burner port. The first sleeve member has a portion thereof concentrically spaced about the second tubular conduit to form an inner annular passageway therebetween and the second sleeve member has a portion thereof concentrically spaced about the first sleeve member to form an outer annular passageway therebetween. Separate damper or register means are provided for apportioning the flow of windbox air between the central passageway, the inner annular passageway, and the outer annular passageway. A plurality of vanes is located in the inner annular passageway and create a swirl to provide adequate mixing of the fuel and air.

An object of the invention is to provide a multifuel burning apparatus wherein the initial burning of the fuel is conducted under a reducing atmosphere thereby inhibiting the formation of fuel nitric oxide and providing the lower peak flame temperature required to minimize the formation of the thermal nitric oxide.

Another object of the invention is to minimize backmixing of the fuel and air in the base of the flame in order to limit the formation of nitrogen oxides and to promote flame stabilization.

Another object of the invention is to provide for the internal introduction of combustion air with respect to the pulverized coal in order to control flame shape and fuel-air mixing.

A further object of the invention is to admit the remaining air required for complete combustion along a flow pattern which surrounds the reducing and stabilizing zones and eventually mixes with the fuel to complete its combustion.

A final object of the invention is to provide a means for the combustion of multiple fuels in combination or independently while minimizing the formation of nitric oxide from the combustion of the aforementioned fuels.

DESCRIPTION OF THE PREFERRED EMBODIMENTS

Figure 1:
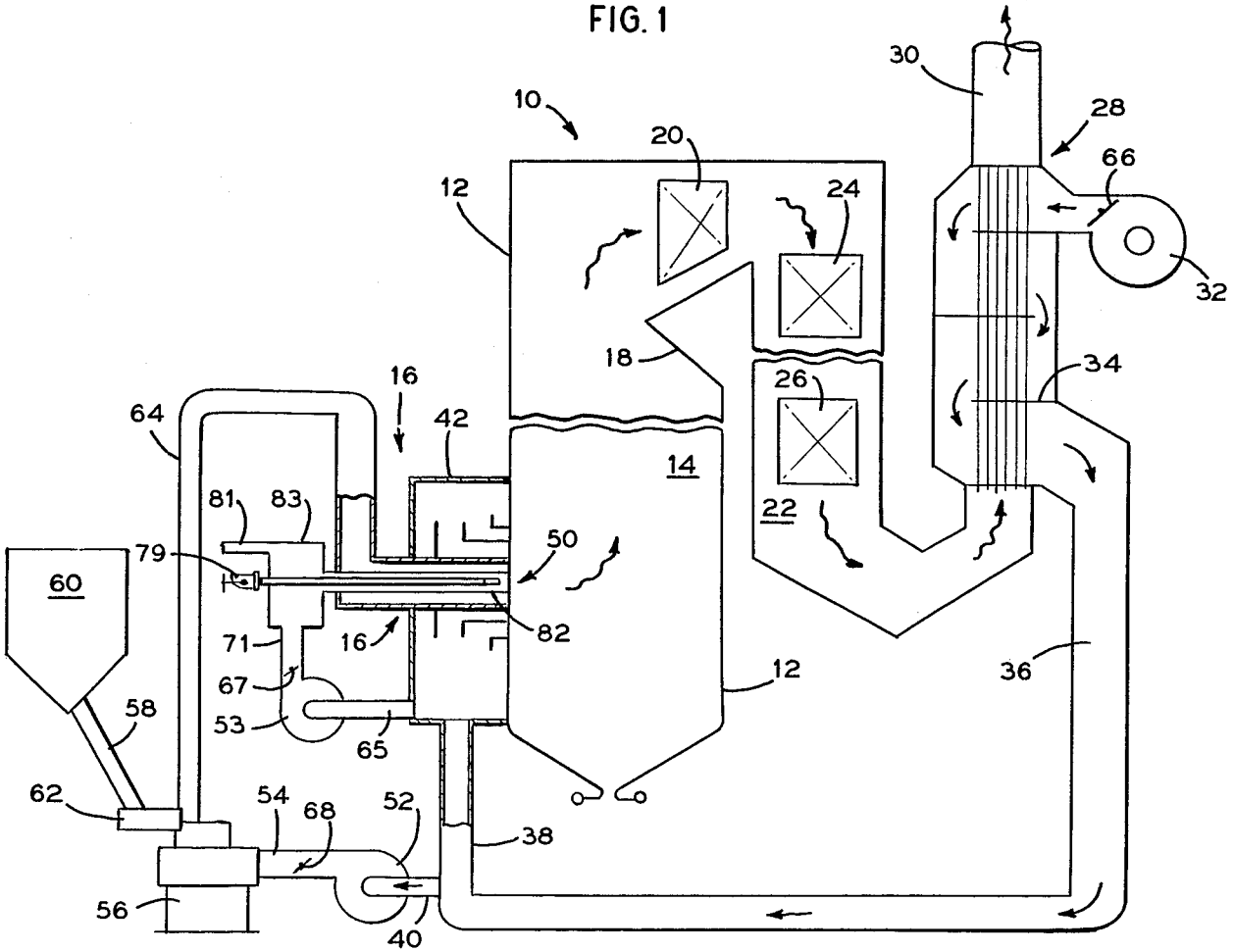
FIG. 1 is a schematic sectional elevation view of a vapor generator using a multi-fuel burning apparatus embodying the invention.

Referring to FIG. 1 there is shown a vapor generator 10 including water cooled walls 12 which define a furnace chamber or combustion space 14 to which carbonaceous fuel and/or a pulverized coal fuel and air mixture is supplied by a multi-fuel burner 16.

After combustion has been completed in the furnace chamber 14, the heated gases flow upwardly around nose portion 18, over tubular secondary superheater 20, and thence downward through convection pass 22 containing tubular primary superheater 24 and economizer 26. The gases leaving the convection pass 22 flow through tubes of an air heater 28 and are thereafter discharged through a flue 30 and are subsequently discharged to the atmosphere by means not shown. It will be understood that the heated gases passing over the surfaces in the furnace 14, the superheaters 20 and 24, and the economizer 26 give up heat to the fluid flowing therethrough and that the gases passing through the air heater 28 give up additional heat to combustion air flowing over the tubes. A forced draft fan 32 supplies combustion air to the vapor generator and causes it to flow over the air heater tubes and around a plurality of baffles 34 and thence through a duct 36 for apportionment between branch ducts 38 and 40 respectively.

The heated air passing through duct 38 is delivered into a windbox 42 and represents a major portion of the air necessary for combustion of the fuel being discharged into burner port 50. The heated air passing through duct 40 is the transport air and the remaining portion of air necessary for combustion and is delivered into a primary air fan 52 wherein it is further pressurized and thereafter conveyed through a duct 54 into an air-swept type pulverizing apparatus 56.

The pulverized coal to be burned as primary fuel in the vapor generator 10 is delivered in raw form via pipe 58 from raw coal storage bunker 60 to a feeder 62 in response to the load demand on the vapor generator 10 in a manner well known in the art. The pulverizer 56 grinds the raw coal to the desired particle size. The pressurized air flowing from the primary air fan 52 sweeps through the pulverizer carrying therewith the ground coal particles for flow through a pipe 64 for dishcarge through the port 50 into the furnace chamber.

The secondary liquid fuel to be burned in vapor generator 10 is delivered to the burner via a pumping system (not shown) to liquid fuel burner assembly 79 in a channel independent of the central combustion air in a manner well known in the art. A portion of the combustion air will be conveyed through duct 65 to the first tubular conduit 82 to burner port 50, by passing fan 53.

In the case of a secondary solid fuel which is supplied to the secondary solid fuel mixing chamber 83 through duct 81 in a manner well known in the art. The combustion air will be used to transport the solid fuel. A portion of the combustion air will be conveyed through duct 65 to fan 53. After exiting fan 53, the combustion air will flow thorugh duct 71 to secondary solid fuel mixing chamber 83 and then the solid fuel and air will flow through the first tubular conduit 82 to burner port 50. Windbox fan 53 is in operation only for the solid secondary fuel application.

A damper 66 is associated with the forced draft fan 32 to regulate the quantity of air being admitted to the vapor generator 10 in response to the load demand. A damper 68 is associated with the primary air fan 52 to regulate the quantity of air being introduced to the pulverizing apparatus 56. A damper 67 is associated with windbox air fan 53 to regulate the quantity of combustion air being admitted to the first tubular conduit 82.

It will be appreciated that for the sake of clarity, the drawings depict one multi-fuel burner associated with one pulverizer where in actual practice there may be more than one burner associated with the vapor generating unit.

Figure 2:
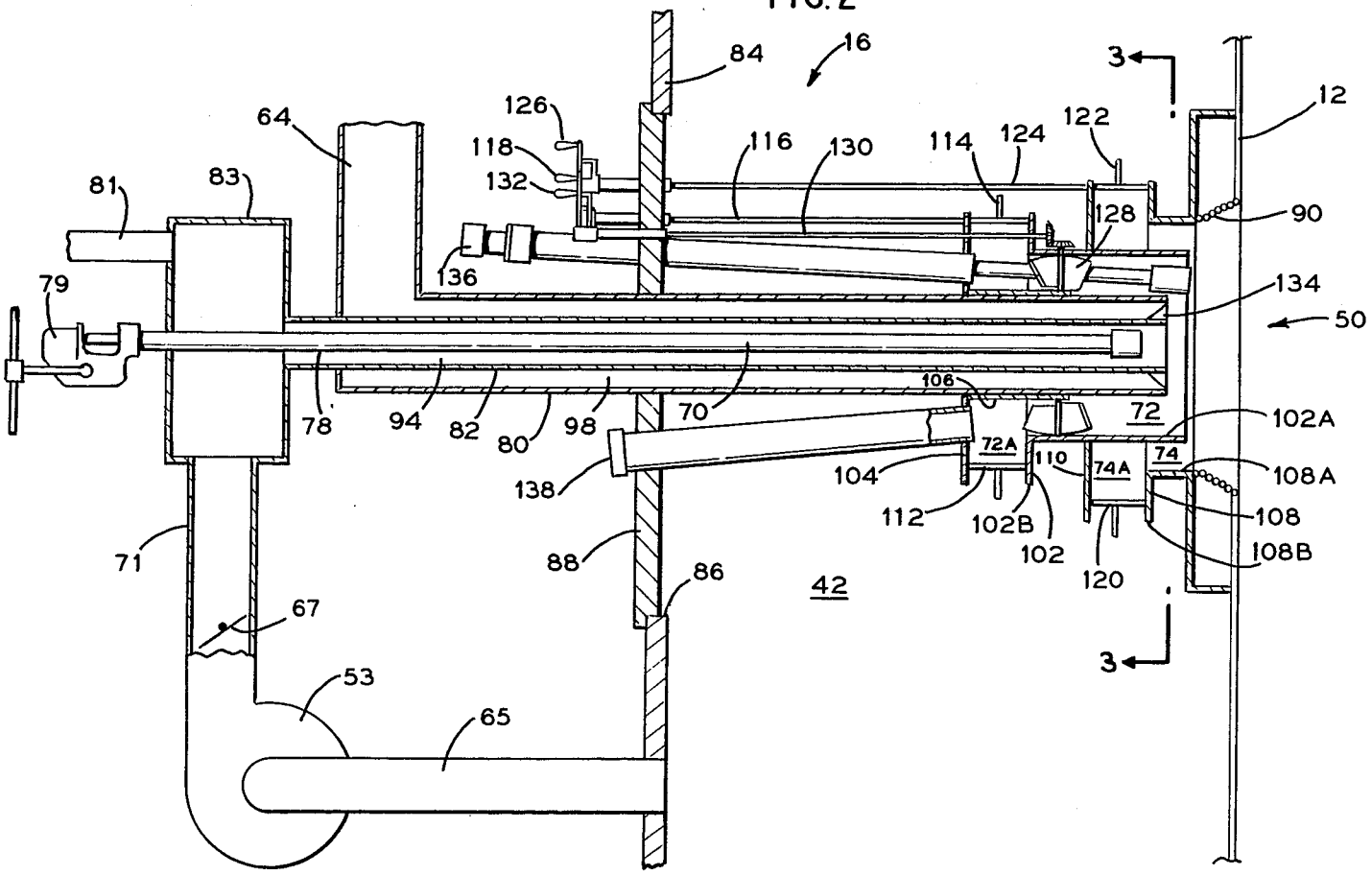
FIG. 2 is a sectional elevation view of the multi-fuel burning embodying the invention.

Referring to FIG. 2 there is shown the multi-fuel burner 16 arranged to fire through the burner port 50, the latter being formed as a frustoconical throat diverging toward the furnace side of the wall 12 and being fluid cooled by tubes 90. An outer burner wall 84, having an access opening 86, is spaced from the furnace wall 12. The space between the burner and furnace walls forms the windbox 42.

The multi-fuel burner includes a first tubular conduit 82 which defines a central passageway 94 and extends through a duct 64 and an access opening cove plate 88, across windbox 42 to a point adjacent the burner port 50. An optional liquid fuel burner assembly 79 is located coaxially within the first tubular conduit 82 and is connected to a fluid fuel and atomizing fluid supply lines (not shown). For the secondary solid fuel option, the inlet portion of first tubular conduit 82 is flow connected to secondary fuel mixing chamber 83. Mixing chamber 83 is flow connected to duct 71 which in turn is connected to windbox fan 53 and duct 65, the latter originating from windbox 42. Mixing chamber 83 is also flow connected to duct 81 through which the secondary solid fuel is supplied. A damper 67 regulates the quantity and velocity of the combustion air flowing through the first tubular conduit 82 and is used to control the flame shape and the mixing pattern of the fuel and air in furnace chamber 14 (FIG. 1). A second tubular conduit 80, concentrically spaced about the first tubular conduit 82, defines a central annular passageway 98 and extends through the access cover plate 88 across windbox 42 to a point adjacent to burner port 50. The inlet portion of the second tubular conduit 80 is flow connected to duct 64 which conveys pulverized coal and a portion of the combustion air from pulverizer 56 (FIG. 1). An optional coal diffuser 134 is situated in the central annular passageway 98.

A first and second sleeve member 102 and 108 respectively are disposed within the windbox 42 to direct combustion air to the throat section formed within burner port 50. The first sleeve member 102 has a portion 102A concentrically spaced about the outlet portion of the second tubular conduit 80 to form an inner annular passageway 72 therebetween. The remaining portion of sleeve 102 is in the form of a flange plate 102B extending laterally outward from the inlet end of portion 102A. An annular wall plate or back plate 104 encircles the second tubular conduit and is connected thereto. The plates 104 and 102B are spaced from one another to form inlet 72A to inner annular passageway 72 which extends normal thereto. The inner periphery of annular plate 104 is also connected to a sleeve-like section 106 extending along a segment of the outlet portion of the second tubular conduit 80 in contiguous surrounding relationship thereto. The second sleeve member 108 has a portion 108A concentrically spaced about the outlet end of sleeve portion 102A to form an outer annular passageway 74 therebetween. The remaining portion of sleeve 108 is in the form of a flange plate 108B extending laterally outward from the inlet end of portion 108A. An annular wall plate 110 encircles the sleeve portion 102A and is connected thereto. The plates 108B and 110 are spaced from one another to form the inlet 74A to outer passageway 74 which extends normal thereto.

A plurality of dampers or registers 112 is located within the inlet 72A to passageway 72 and is circumferentially and equidistantly spaced and pivotally connected between and adjacent the outer periphery of the plates 102B and 104. The dampers 112 are adapted to pivot between open, closed and intermediate positions and are preferably interconnected through a linkage train 114 so as to be collectively and simultaneously adjustable through a shaft member 116 operatively connected thereto and terminating outside of the windbox 42 and connected to a manually operated handle 118.

A plurality of dampers or registers 120 is located within the inlet 74A to passageway 74 and is circumferentially and equidistantly spaced and pivotally connected between and adjacent the outer periphery of the plates 108B and 110. The dampers 120 are adapted to pivot between open, closed and intermediate positions and are preferably interconnected through a linkage train 122 so as to be collectively and simultaneously adjustable through a shaft member 124 operatively connected thereto and terminating outside of the windbox 42 and connected to a manually operated handle 126.

A plurality of vanes 128 is arranged in surrounding relationship to the sleeve-like section 106 and is located within the inner annular passageway 72. The vanes 128 are equidistantly spaced and preferably linked to one another so as to be collectively and simultaneously adjustable through a shaft member 130 operatively connected thereto and terminating outside of the windbox 42 and connected to a manually operated handle 132. The vanes 128 have the principal function of imparting a rotational component to the combustion air flowing through the inner annular passageway.

If desired, the shaft members 116, 124 and 130 may be suitably geared or otherwise connected to an operating means (not shown) which would be responsive to an automatic control.

An ignitor assembly 136 of known type extends through cover plate 88 and through the back plate 104 and terminates at the discharge end of annular space 72. For certain secondary solid fuel, the ignitor assembly 136 can be located in the central passageway 94 instead of the liquid fuel burner assembly 79. An observation tube 138 extends through the cover plate 88 and through the back plate 104 and terminates adjacent to the inside of back plate 104.

Figure 3:
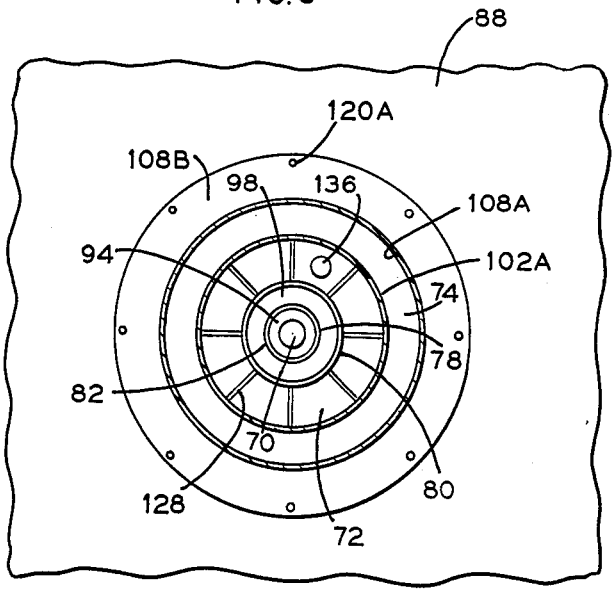
FIG. 3 is a transverse cross-sectional view taken along Lines 3—3 of FIG. 2.

FIG. 3 shows a fragmented portion of the windbox side of cover plate 88 and includes the flange plate 108B with pivots 120A of the dampers 120 extending therethrough. The sleeve portions 108A and 102A cooperate with one another to form the outer annular passageway 74 therebetween and the second tubular conduit 80 and sleeve portion 102A cooperate to form the inner annular passageway 72 therebetween. The passageway 72 houses the vanes 128. The second tubular conduit 80 and the first tubular conduit 82 define the outlet portion of the central annular passageway 98. An optional coal diffuser 134 is situated in the central annular passageway 98. (Shown in FIG. 2). The first tubular conduit 82 defines the outlet portion of the central passageway 94. Located within the central passageway 94 is optional liquid fuel burner assembly 79. (Shown in FIG. 2).

In the operation of the preferred embodiment, the fluid fuel to be burned in the furnace 14 is deliverd via supply lines (not shown), atomized within the fuel burner 16 and sprayed into the burner port 50. The secondary solid fuel to be burned in the furnace 14 is delivered via duct 81 from a storage bunker (not shown) utilizing the air from duct 71 to transport the solid fuel into the burner port 50. The quantity of air supplied being regulated by a damper device 67 to provide sufficient air to transport the secondary fuel. The coal to be burned in the furnace 14 is delivered in raw form via pipe 58 from the raw coal storage bunker 60 to the pulverizer feeder 62, which regulates the quantity of coal supplied to the pulverizer 56 in response to the load demand on the vapor generator 10 in a manner well known in the art. The pulverizer 56, being of the air-swept type, is supplied with pressurized combustion and transport air from a primary air fan 52, the quantity of air supplied being regulated by a damper device 68 to provide sufficient air to initiate ignition at the burner discharge and provide adequate flow velocity to insure a thorough sweeping of the pulverizer 56, coal burner pipe 64 and the central annular passageway 98.

The air required for combustion is delivered to the vapor generator by a forced draft fan 32 including a damper device 66 which regulates the quantity of air in response to the load demand on the vapor generator 10 in a manner well known in the art. The combustion air is heated as it comes into indirect contact with the flue gases flowing through the tubes of an air heater 28 and is thereafter conveyed through a duct 36 to be apportioned between branch ducts 40 and 38, the former leads to the pulverizer 56 as aforedescribed and the latter leads to the windbox whence the air is apportioned between the central passageway 94 via duct 65 and 71, the inner annular passageway 72, and the outer annular passageway 74.

From the foregoing, it will be noted that four separate flow paths are provided for admitting combustion air to the burner port 50; the central passageway 94, the central annular passageway 98, the inner annular passageway 72, and the outer annular passageway 74. The design of these flow paths and the regulation of the proportional amounts of air passing through these flow paths coupled with the enhancement of fuel-air distribution and the shaping of the fuel discharge pattern constitute major features of the present invention.

Under actual operation, it has been found that maintaining combustion air which flows through the central passageway 94 within a range of 5 to 10 percent of stoichiometric air, that which flows through the central annular passageway 98 within a range of 15 to 30 percent of stoichiometric air, and that which flows through the inner annular passageway 72 within a range of 22 to 35 percent of stoichiometric air creates a stable ignition zone under a reducing atmosphere and provides lower peak flame temperature. The combustion air which flows through the outer annular passageway 74 represents the air needed to complete the combustion of the fuel.

While in accordance with the provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. A multi-fuel burning apparatus comprising:

a first tubular conduit, defining a central passageway, opening in a burner port for discharge and combustion of fuel in a combustion chamber, means for supplying an air-conveyed solid carbonaceous fuel to the first tubular conduit for discharge and combustion in the combustion chamber, a liquid fuel assembly centrally extending within the first tubular conduit for discharge and combustion of a liquid fuel in the combustion chamber, a second tubular conduit concentrically disposed about the first tubular conduit and defining a central annular passageway for discharge and combustion of fuel in the combustion chamber, means for supplying air-conveyed pulverized coal to the central annular passageway, a first sleeve member having a portion thereof concentrically spaced about the second tubular conduit to form an inner annular passageway for delivery and supply of combustion air to the combustion chamber, a second sleeve member having a portion thereof concentrically spaced about the first sleeve member to form an outer annular passageway for delivery and supply of additional combustion air to the combustion chamber, means for separately controlling the amounts of combustion air to the first tubular conduit, the second tubular conduit, the inner annular passageway and the outer annular passageway for low $NO_x$ production, and wherein the control of combustion air is such that 5 to 10 percent of stoichiometric air is delivered to the central passageway, 15 to 30 percent to the central annular passageway, 22 to 35 percent to the inner annular passageway, and the remaining combustion air for complete combustion to the outer annular passageway.

* * * * *